US005105706A

United States Patent [19]

Lombardi

[11] Patent Number: 5,105,706

[45] Date of Patent: Apr. 21, 1992

[54] MUSIC STAND PEDAL FRAME AND DUAL LEG SUPPORT

[76] Inventor: Donald G. Lombardi, 2118 E. Hillcrest Dr., Thousand Oaks, Calif. 91360

[21] Appl. No.: 640,993

[22] Filed: Jan. 14, 1991

[51] Int. Cl.[5] ..... G10D 13/02

[52] U.S. Cl. ..... 84/422.3; 248/125

[58] Field of Search ..... 84/421, 422.1, 422.2, 84/422.3; 248/125, 166

[56] References Cited

U.S. PATENT DOCUMENTS 4,381,690 5/1983 Kimble ..... 84/422.3
4,606,525 8/1986 Lombardi ..... 84/421 X
4,756,224 7/1988 Lombardi ..... 84/422.1
4,819,536 4/1989 Lombardi ..... 84/746
4,899,028 12/1989 Lombardi ..... 84/421

*Primary Examiner*—L. T. Hix
*Assistant Examiner*—Howard B. Blankenship
*Attorney, Agent, or Firm*—William W. Haefliger

[57] ABSTRACT

An apparatus for supporting and operating a percussion instrument, the combination comprising an upright standard to carry the instrument; two spaced support legs connected with the standard; and a collapsible support frame connected with the standard and spaced from the two legs, and a foot pedal carried by the frame for foot operated movement; there also being an upright instrument actuating member operatively connected with the pedal.

13 Claims, 3 Drawing Sheets

FIG. 1.
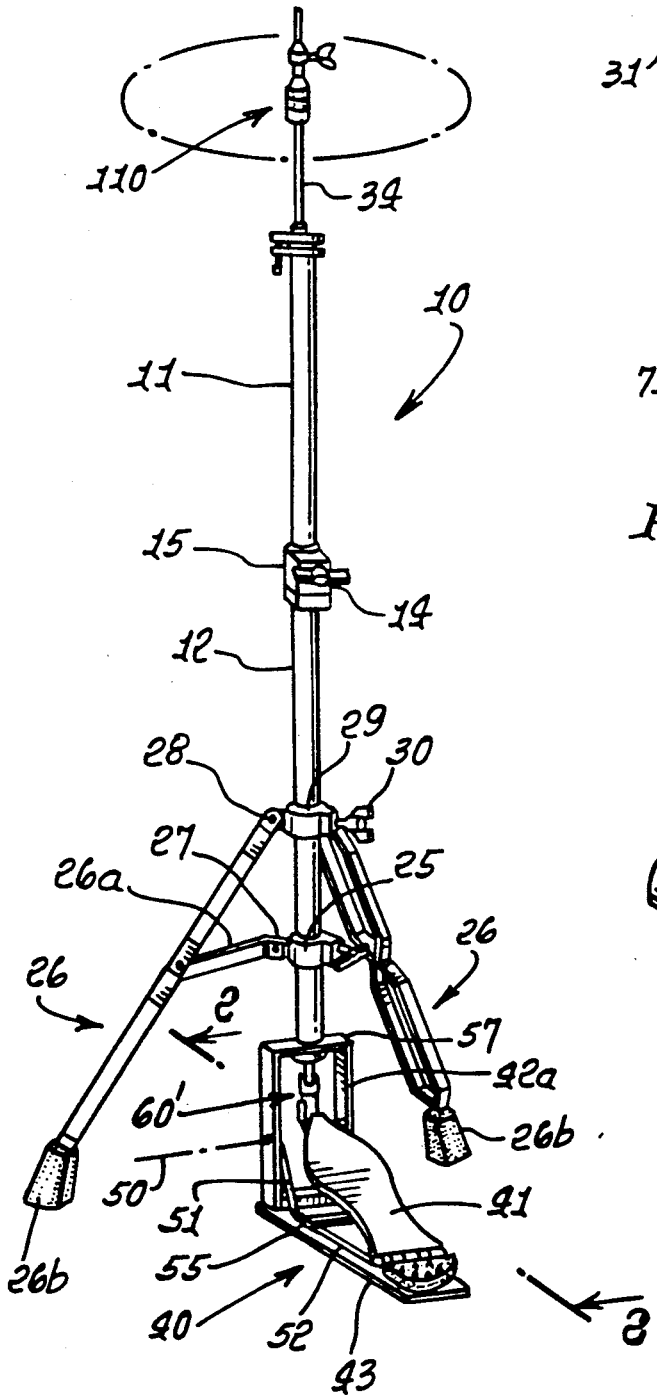
FIG. 1a.
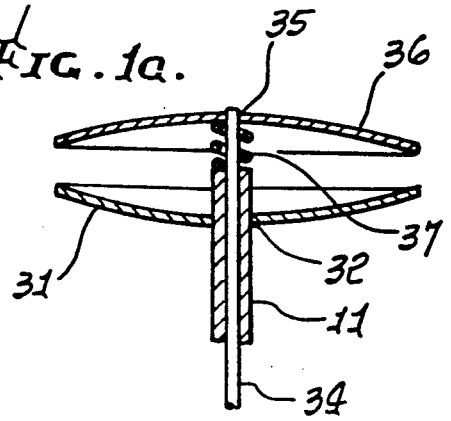
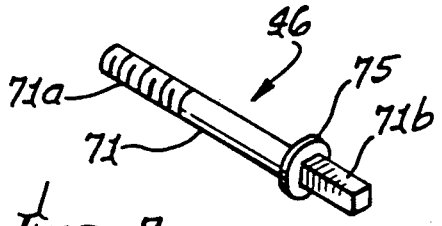
FIG. 7.
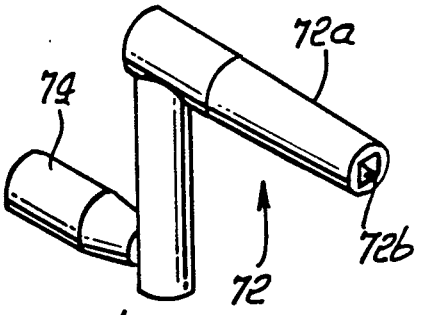
FIG. 8.

MUSIC STAND PEDAL FRAME AND DUAL LEG SUPPORT

BACKGROUND OF THE INVENTION

This invention relates generally to percussion instrument stands or standards, and more particularly to collapsible means to support such standards and which accommodate pedal actuation of a percussion instrument.

There is need for improved percussion instrument supports or standards, allowing rapid collapse of such standards for transportation, as well as their rapid extension for use of the percussion instrument. There is also need for improved accommodation of such collapsible standards to pedal actuation of percussion instruments, as for example cymbals. In the past, such standards were supported on three like legs, but this arrangement interferes with desired pedal actuation.

SUMMARY OF THE INVENTION

It is a major object of the invention to provide a support apparatus meeting the above needs, in a simple, effective manner. Basically, the apparatus integrates a percussion instrument two legged support with a pedal support which also functions to support the standard, and includes:

a) an upright standard to carry the instrument, b) two spaced support legs connected with the standard, c) and means including a collapsible support frame connected with the standard and spaced from said two legs, and a foot pedal carried by the frame for foot operated movement, d) there also being an upright instrument actuating member operatively connected with the pedal.

As will be seen, the support frame may advantageously comprise first and second elements which are relatively movable between collapsed and extended positions, at least one of said elements in its extended position acting in conjunction with such legs to support the standard, and a holder for releasably holding said elements in relatively extended positions. Also, the first element typically comprises a sub-frame extending upright in its extended position, and said second element comprises a base plate, the pedal having hinged connection to the base plate.

It is another object to provide the standard lower end to be carried by the sub-frame, the standard being tubular, and said actuating member extending within the tubular standard and projecting below the standard lower end for hinged connection to the pedal. In this environment, strut means may be provided to be supported by the base plate and projecting above said base plate, there being a hinged connection between said strut means and the sub-frame, above the base plate, whereby the sub-frame and standard are swingable from collapsed generally horizontal positions above the pedal into upright positions. Further, the sub-frame in upright position may have its lower end portion extending into proximity to the base plate, as enabled by the strut means, the holder releasably connecting said sub-frame lower end portion to the base plate.

A further object is to provide the holder in the form of an elongated fastener, there being fastener receiving bores on said base plate and sub-frame to be brought into alignment when said sub-frame is swung into its said extended upright position.

Yet another object is to provide for the pedal to be inclined upwardly and forwardly from said hinged connection to the base plate to said hinged connection to the actuating member to the base plate to said hinged connection to the actuating member.

In this regard the pedal is foot operable up and down to move the actuating member or rod in similar means to actuate the percussion instrument, the sub-frame and base plate orienting the pedal relative to the standard and actuating member, since the holder locks the sub-frame and base plate in their extended positions.

These and other objects and advantages of the invention, as well as the details of an illustrative embodiment, will be more fully understood from the following specification and drawings, in which:

BRIEF DESCRIPTION OF THE DRAWINGS

FIG. 1 is a perspective view of apparatus incorporating the invention;

FIG. 1*a* is a schematic showing of cymbals and their actuation;

FIG. 7 is a perspective view of a holder in the form of a fastener; and

FIG. 8 is a perspective view of a hand operable tool or wrench, to easily rotate the fastener in opposite direction, during collapse or extension of the apparatus.

DETAILED DESCRIPTION

Figure 2:
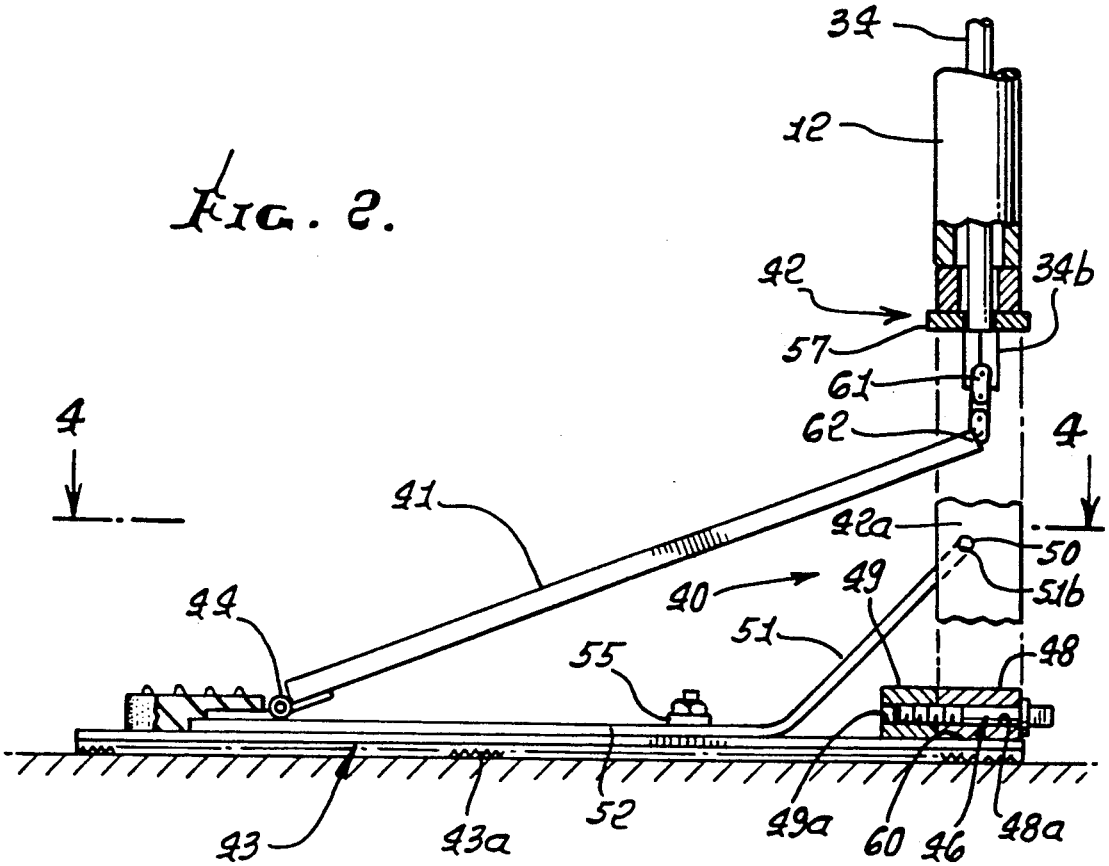
FIG. 2 is an enlarged side elevation, partly in section, and taken on lines 2—2 of FIG. 1, the components being in extended and locked condition.

In the drawings, the music stand 10 includes multiple, relatively telescoping sections. These include for example upper section 11 telescopically receivable within the lower section 12. A clamp 14 mounted at 15 on the upper end of section 12 is manually operable to clamp a friction ring against the side of section 11, thereby to retain the sections in the position shown. When the clamps are loosened, the sections are relatively telescopically movable as from collapsed position to desired extended position, as manually controlled by the musician when he sets up his equipment.

FIG. 1 also shows two collapsible legs 26 with links 26*a* attached at 27 to ring 25 on the lower section and at 28 to a slide ring 29 slidable axially on the lower section. A clamp 30 clamps the ring to that section. Rings 25 and 29 are rotatable on 12 to selectively position the legs relative to a frame 40. Also schematically shown, in FIG. 1*a*, is a cymbal 31 attached at 32 to the upper tubular section 11. A vertically movable rod 34 is attached at 35 to an upper cymbal disc 36. As rod 34 is moved down in 11 and 12, spring 37 is compressed, and upper cymbal 31 strikes the lower cymbal disc 32.

Figure 3:
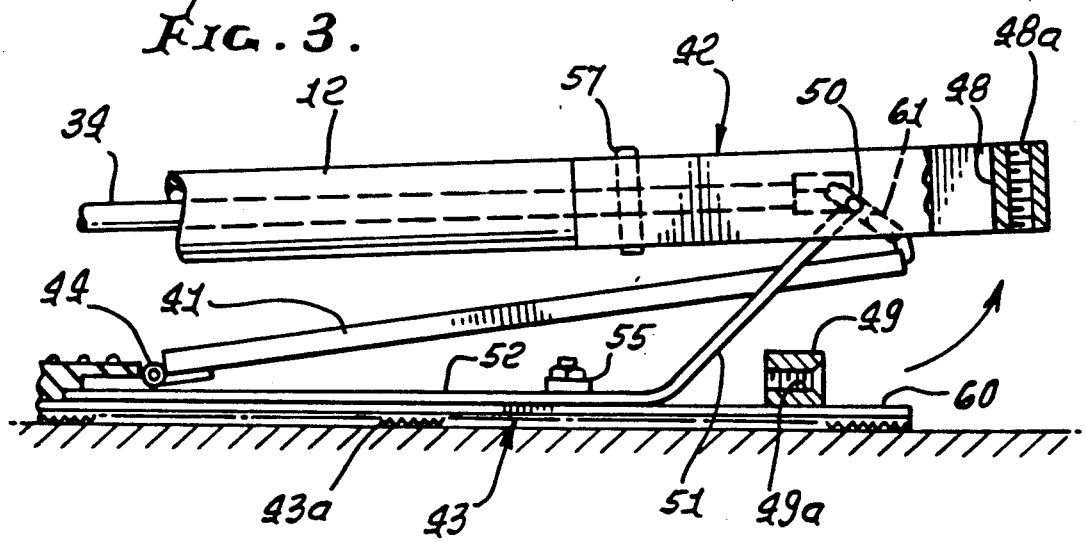
FIG. 3 is a view like FIG. 2, showing the components in collapsed position.
Figure 4:
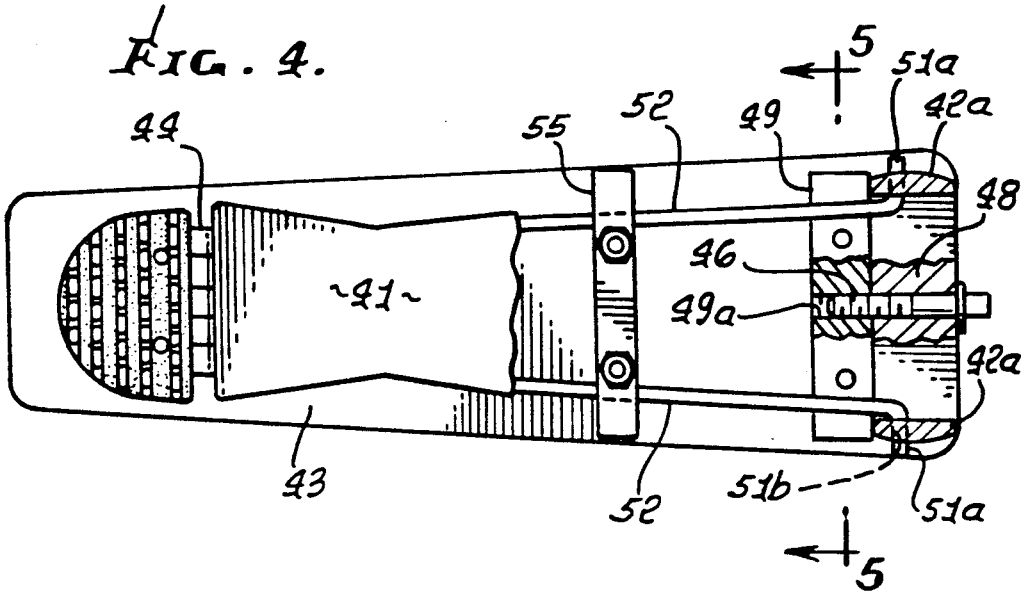
FIG. 4 is a plan view taken on lines 4—4 of FIG. 2.
Figure 5:
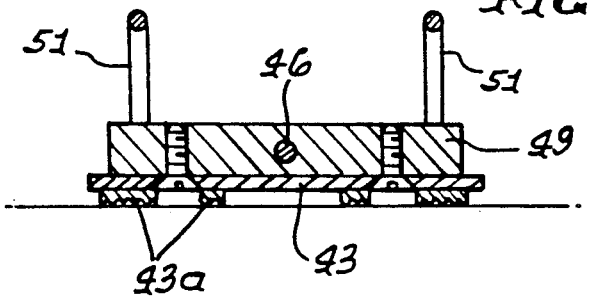
FIG. 5 is a section taken in elevation on lines 5—5 of FIG. 4.
Figure 6:
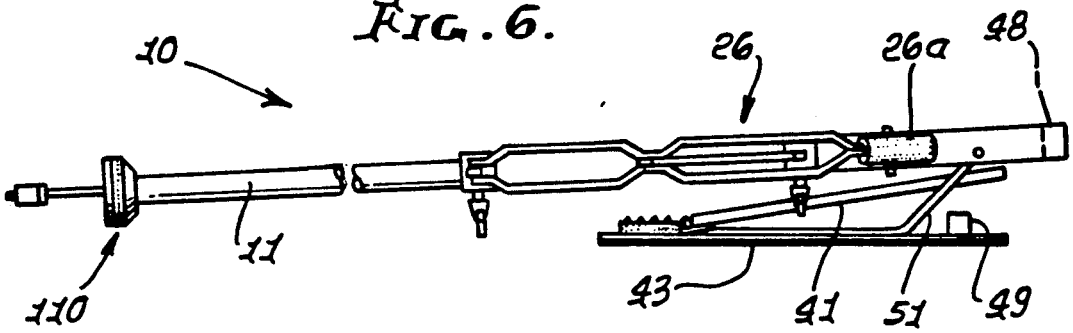
FIG. 6 is a side elevation shown, the complete stand and its support apparatus in collapsed position.

Extending the description to FIGS. 2 and 3, means is provided including a collapsible support frame 90 connected with the standard 10 lower section 12, and spaced from the two legs 26, to support the standard. The frame also supports a foot pedal 41, which is connected with the rod 34 to move it down to cause engagement of the cymbals discs, as described.

The support frame is shown to include first and second elements, as in the form of an upright sub-frame 42 and a horizontal base plate 43, respectively. The base plate incorporates a thin elastomeric support pad 43*a*, at its underside. The rearward end of the pedal 41 has hinge connection at 44 to the base plate, and it extends forwardly and upwardly toward the sub-frame. The elements 42 and 43 are relatively movable between collapsed and extended positions, as seen for example in FIG. 3 (collapsed) and FIG. 2 (extended). Note that strut means as at 51 allows the sub-frame 42 and standard to be retained above the pedal, when collapsed. A holder is provided for releasably holding the elements in their selectively extended positions, and is removable to allow element collapse. See for example the holder in the form of elongated screw type fastener 46 threadably receivable into alignable threaded bores 48*a* and 49*a* in members 48 and 49 respectively connected to elements 42 and 43, as above. Such bore alignment occurs when the sub-frame 42 is swung clockwise about a transverse pivot axis 50, into its extended, vertically upright position, of FIG. 2. That pivot axis 50 is provided by strut means in the form of two rod-like transversely spaced struts 51 supported at 52 on the base plate. The struts project forwardly and the upwardly to terminate at laterally turned ends 51*a* defining pivots at the members 53 and 54 of the sub-frame. Those members define lateral through openings 51*b* that pass the turned ends 51*a*. Horizontal extents 52 of the struts are clamped at 55 to the lower plate.

Accordingly, the holder or fastener 41 allows the elements 42 and 43 to be held in their FIG. 1 and 2 positions, thereby to provide a third supporting leg for the standard 10. The latter has its lower end connected to the sub-frame upper cross-piece 57, which directly supports the standard. The sub-frame lower cross-piece or member 48 seats on the base plate, as at 60, in FIG. 2.

FIGS. 1-3 also illustrate the provision of a multi-link connection as at 60 between the pedal forward end 62 and the lower end extent 34*a* of the rod 34, such a multi-link connection accommodates the swinging of the sub-frame and rod 34 between FIGS. 2 and 3 positions, the pedal 41 being somewhat lower in FIG. 3 than in rod operating position of FIG. 2. The link connection shown includes interconnected, relatively pivotable chain links 61, the uppermost connected to a lower enlarged extension 34*b* of rod 34. Note the relative pivoting of such links 61, in FIGS. 2 and 3. Elements 34*b*, 61 and 62 are straddled by the laterally spaced uprights 42*a* defined by the sub-frame 42, allowing generally direct vertical alignment of the links 61 with end 34, for malfunction free operation of the cymbals, as in FIG. 2.

FIG. 7 shows the fastener 46 to have a shank 71, threaded at 71*a*, and provided with end flats at 71*b*, for engagement by a crank 72 seen in FIG. 8. The crank has a sleeve 72*a* provided with internal flats at 72*b*, to fit over flats 71*b*, and transmit rotation to the shank 71 as the crank offset handle 74 is rotated. See also stop flange 75 on the shank 71.

Leg 26 lower ends appear at 26*a*. A cymbals holder appears at 110 in FIG. 1.

I claim:

1. In apparatus for supporting and operating a percussion instrument, the combination comprising:

a) an upright standard to carry the instrument, b) two spaced support legs connected with the standard, c) and means including a collapsible support frame connected with the standard and spaced from said two legs, and a foot pedal carried by the frame for foot operated movement, d) there also being an upright instrument actuating member operatively connected with the pedal, e) said support frame including first and second elements which are relatively movable between collapsed and extended positions, at least one of said elements in its extended position acting in conjunction with such legs to support the standard, and means for releasably holding said elements in relatively extended positions.

2. In apparatus for support and operating a percussion instrument, the combination comprising a) an upright standard to carry the instrument, b) two spaced support legs connected with the standard, c) and means including a collapsible support frame connected with the standard and spaced from said two legs, and a foot pedal carried by the frame for foot operated movement, d) there also being an upright instrument actuating member operatively connected with the pedal, e) said support frame including first and second elements which are relatively movable between collapsed and extended positions, at least one of said elements in its extended position acting in conjunction with such legs to support the standard, and a holder for releasably holding said elements in relatively extended positions.

3. The combination of claim 2 wherein said first element comprises a sub-frame extending upright in its extended position, and said second element comprises a base plate, the pedal having hinged connection to the base plate.

4. The combination of claim 3 wherein said standard has a lower end carried by the sub-frame, the standard being tubular, and said actuating member extending within the tubular standard and projecting below the standard lower end for hinged connection to the pedal.

5. The combination of claim 4 including strut means supported by the base plate and projecting above said base plate, there being a hinged connection between said strut means and the sub-frame, above the base plate, whereby the sub-frame and standard are swingable from collapsed generally horizontal positions above the pedal into upright position.

6. The combination of claim 5 wherein the sub-frame in upright position has a lower end portion extending into proximity to the base plate, the holder releasably connecting said sub-frame lower end portion to the base plate.

7. The combination of claim 6 wherein said holder comprises an elongated fastener, there being fastener receiving bores on said base plate and sub-frame to be brought into alignment when said sub-frame is swung into its said extended upright position.

8. The combination of claim 5 wherein said holder comprises an elongated fastener, there being fastener receiving bores on said base plate and sub-frame to be brought into alignment when said sub-frame is swung into its said extended upright position.

9. The combination of claim 8 wherein the pedal is inclined upwardly and forwardly from said hinged connection to the base plate to said hinged connection to the actuating member.

10. The combination of claim 9 wherein said instrument comprises a cymbals having two discs one of which is connected to said actuating member which is vertically movable by the pedal.

11. The combination of claim 2 wherein said one element extends directly beneath standard in extended position, and the other element then extends generally horizontally away from said element at the same level as the lowermost extents of said legs.

12. The combination of claim 2 including a multi-link connection between the pedal and said member, allowing both collapse of the member and support frame one element relative to the pedal, and extension of said one element and said member to extend above the pedal in an instrument playing position.

13. The combination of claim 1 wherein the standard includes relatively telescopically interfitting tubular parts, said two support legs swingably mounted on one of said parts to rotate relative to said frame.

* * * * *